United States Patent [19]

Hawkins

[11] Patent Number: 4,634,115

[45] Date of Patent: Jan. 6, 1987

[54] ARM WRESTLING AND CURLING MACHINE APPARATUS

[76] Inventor: David E. Hawkins, 411 Glen Oaks Dr., Knoxville, Tenn. 37912

[21] Appl. No.: 615,064

[22] Filed: May 29, 1984

[51] Int. Cl.[4] ..... A63B 5/00

[52] U.S. Cl. ..... 272/67; 272/142; 272/901

[58] Field of Search ..... 272/67.68, 130, 135, 272/136, 141, 140, 142, 901

[56] References Cited

U.S. PATENT DOCUMENTS

| | | | |
|---|---|---|---|
| 2,223,309 | 11/1940 | Swanson | 272/141 |
| 3,662,602 | 5/1972 | Weiss | 272/142 X |
| 3,953,026 | 4/1976 | Stokely | 272/140 |
| 4,129,297 | 12/1978 | Dolan | 272/67 |
| 4,157,179 | 6/1979 | Ecklor, Jr. | 272/67 |
| 4,214,748 | 7/1980 | Blackmon | 272/67 |
| 4,351,523 | 9/1982 | Alexander | 272/67 |
| 4,482,149 | 11/1984 | Weldon | 272/67 |

*Primary Examiner*—Richard J. Apley
*Assistant Examiner*—David J. Brown
*Attorney, Agent, or Firm*—Pitts and Brittian

[57] ABSTRACT

An arm wrestling and curling exercise apparatus comprises a rectangular frame having oppositely disposed side walls joined by end walls. The apparatus further comprises a handle assembly having a pivotally mounted T-shaped handle support member comprising a horizontally aligned pivot shaft carrying a lever arm extending perpendicularly therefrom for the purpose of mounting the handle support member. The pivot shaft carries a pair of sleeve members mounted on either side of the lever arm. Each of the sleeve members carries a downwardly extending cable post. The lever arm is slidably receptive of a cylindrical housing member which passes over the upper cap bushing, the spring biasing means and the slidable bushing to be threadably received by the lower cap nut. The lever arm is also provided with a grip member which is releasably secured to the cylindrical housing. The apparatus is further provided with a biasing means for selectively controlling the resistance under which the lever arm rotates during operational use. A cable member is pivotally attached to each of the cable posts. Each cable is extended under the lower transverse bar and through the sheave member; the cable then extends to a rectangular biasing connection unit. A biasing component is releasably secured to the biasing connection unit at one end, and releasably secured to a biasing retainer member at the other end. The invention can be provided in two operational embodiment: arm wrestling and arm curling with selective resistance levels.

18 Claims, 8 Drawing Figures

ARM WRESTLING AND CURLING MACHINE APPARATUS

TECHNICAL FIELD

This invention relates generally to arm exercising devices, and more specifically to arm wrestling devices and improvements in the method of mechanical arm wrestling. The invention forms part of a broader category of muscle exercisers, used for building endurance and strength with regard to arm, wrist, hand, back, shoulder and neck muscles.

BACKGROUND ART

The arm exercising devices of the prior art are generally complex in mechanical construction, and, in many cases, must be fixedly secured to a supporting device to prevent sliding or other movement during operational use. Mechanical complexity has also contributed to difficulty in assembly and necessity for bothersome repairs.

A number of prior art patents disclose apparatus designed to facilitate arm exercise. For example, U. S. Pat. No. 2,782,033, issued to E. Ugartechea, Feb. 19, 1957, discloses a pivoted U-shaped upright. Springs connect between a cross member on top of same to a base support. The upright and base support are not portable but are fixed to a table or other supporting device.

U. S. Pat. No. 4,214,748, issued to C. V. Blackmon, July 29, 1980, discloses a base, a U-shaped rod member having its base pivotally connected to the base, a U-shaped bolt member whose arms are attached to the U-shaped rod member, and a spring biasing means.

Other examples include U. S. Pat. Nos. 3,059,476, 3,633,907, 4,129,297, 4,343,465, and 4,351,523.

Accordingly, it is one object of the present invention to provide an arm curling exercise apparatus together with an arm wrestling apparatus, facilitating the selective use of either type of exercise. In the arm wrestling mode, the apparatus will present itself as a prospective opponent with selectable muscle resistance levels. When operating in the arm curling mode, the participant is presented with selectively different resistances to lift against in the process of performing the curl exercise with the hand and arm. Consequently, it is an objective to make variable resistances available in both the arm wrestling and arm curling modes.

It is also an objective of the present invention through its spring-cable biasing means to provide a more sensitive resistance control means during the course of exercising. This will permit a wider range of resistances to exercise movements. It will also be an objective to provide an easier method of changing resistance pressure, and a means which will be less likely to need repair during its operational use.

Another objective of the present invention will be to provide a handle means which will extend outwardly during the movement of the arm in the course of arm wrestling or curl exercising, so as to be self-adjusting during the course of exercise, adjustably compensating for the relative change of arm length during exercise. In this manner, it is an objective to provide a handle assembly which will move outwardly against a biasing force with the pressure of the hand and arm during exercise, and will, in accordance with said biasing force, move back into initial starting position as the hand and arm are brought back to their starting position. The additional objective will be to simulate more accurately the change in length of an arm as it participates in either the arm wrestling exercise or the arm curling exercise, thus presenting the arm with a more natural, more evenly displaced, resistance level to work against.

DISCLOSURE OF THE INVENTION

In accordance with the present invention, an arm wrestling and curling machine apparatus is provided with a frame member, a handle assembly and a biasing means. The handle assembly is pivotally mounted on the frame member and provided with an axially reciprocable grip means. The biasing means is connected between the handle assembly and the frame member for biasing the handle assembly to preselected pivotal positions whereby the biasing means provides resistance against which exercise is performed.

BEST MODE FOR CARRYING OUT THE INVENTION

Figure 1:
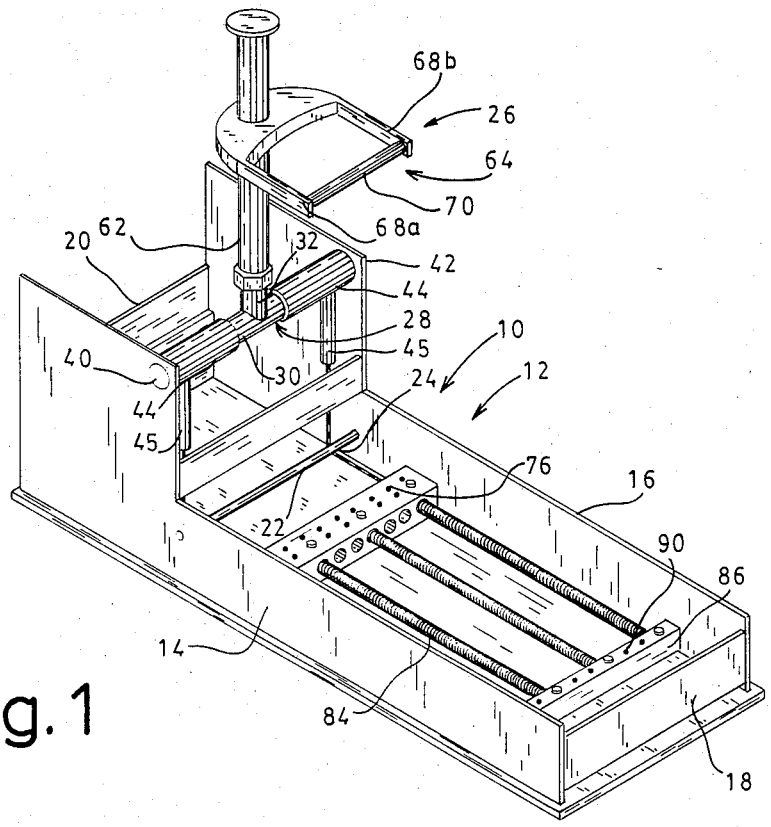
FIG. 1 is a perspective view of an arm wrestling and curling exercise apparatus in the arm wrestling position.
Figure 1A:
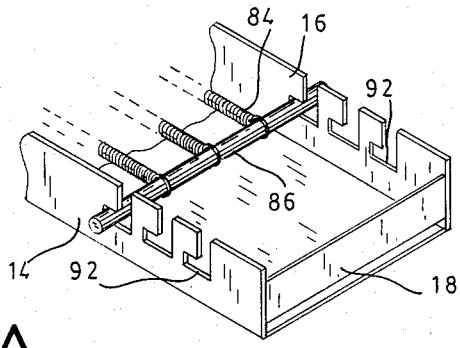
FIG. 1A is a partial perspective view of an alternative embodiment of the invention.

An arm wrestling and curling exercise apparatus incorporating various features of the present invention is illustrated generally at 10 in the Figures. As illustrated in FIG. 1, the apparatus 10 comprises a rectangular frame 12 having oppositely disposed side walls 14 and 16, joined by end walls 18 and 20. The frame 12 is preferably fabricated of a strong durable steel or other metal, but it will be appreciated that various other strong and durable materials may be used. The frame 12 is provided with a horizontally disposed lower transverse bar 22 secured at its opposite portions to the side walls 14 and 16. The lower bar 22 is provided with a pair of selectively spaced rotatably mounted sheave members 24 the function of which will be discussed below.

Figure 2:
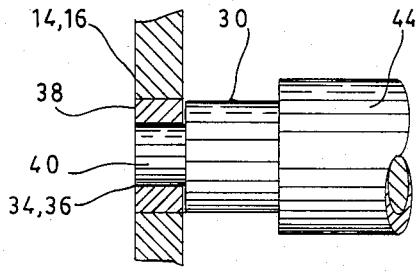
FIG. 2 is a partial cross-sectional view of an annular bushing member receptive of a pivot shaft through the side walls of the invention.

The apparatus 10 further comprises a handle assembly 26 having a pivotally mounted, T-shaped handle support member 28 comprising a horizontally aligned pivot shaft 30 carrying a lever arm 32 extending perpendicularly therefrom for the purpose of mounting the handle support member 28. In a preferred embodiment, illustrated in FIG. 2, the side walls 14 and 16 are provided with journaling holes 34 and 36, respectively, carrying annular bushing members 38 (see FIG. 2). Accordingly, the opposite end portion 40 and 42 of the pivot shaft 30 are rotatably received in the bushing members 38. It will be appreciated by those versed in the art that a suitable annular bearing could be used in place of the bushing members 38 to further facilitate the friction free pivoting of the handle assembly 26.

Figure 3:
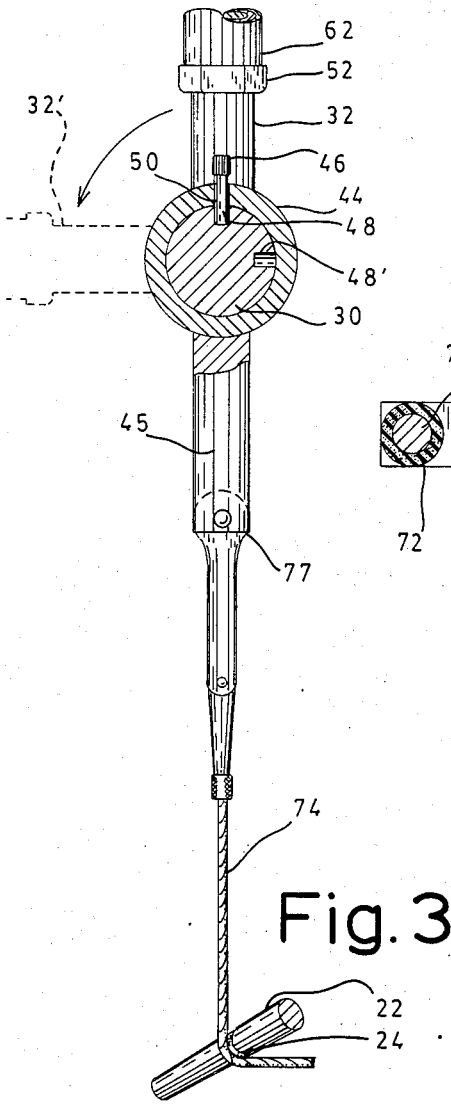
FIG. 3 is a partial cross-sectional view of the selective fastening pin registering means between the pivot shaft and the sleeve members, and the attachment and routing of the cable member.

As illustrated in FIG. 1, the pivot shaft 30 carries a pair of sleeve members 44 one mounted on either side of the lever arm 32. Each of the sleeve members 44 carries a downwardly extending cable post 45, the function of which will be discussed below. Further, as illustrated in FIG. 3, the sleeve members 44 are each provided with a fastening pin 46 for releasably and selectively securing the rotational position of the sleeve members 44 on the shaft 30. In this regard, in the preferred embodiment of FIG. 3, the shaft 30 is provided with a pair of holes 48 and 48', located proximate the mid-portion of the sleeve members 44 as the members 44 are mounted on the shaft 30, and each sleeve member is provided with a hole 50 for registering with either the hole 48 or hole 48', depending upon the rotation position of the shaft 30. Thus, the relative position of the sleeve member 44 may be altered by selectively rotating the shaft 30 such that either hole 48 or 48' registers with the hole 50 of the sleeve member 44 and inserting the pin 46 to releasably secure such relative position.

Figure 4:
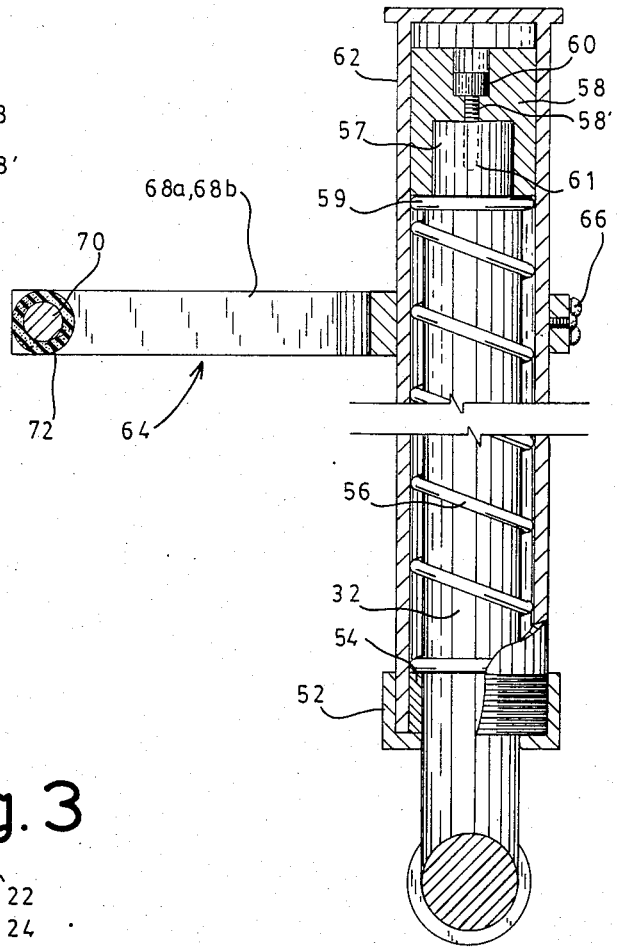
FIG. 4 is a cross-sectional view of the handle assembly.

As illustrated in FIG. 4, the lever arm 32 is further provided with a lower cap nut 52 which is provided on its inner surface with appropriate threading. The lever arm 32 is slidably receptive of the lower cap nut 52. The lever arm 32 is also slidably receptive of a lower annular, slidable bushing 54 which is seated in position against the bottom portion of the lower cap nut 52. The lever arm 32 is then slidably receptive of a spring biasing means 56 which seats itself in position against the lower slidable bushing 54. An upper portion 57 of the lever arm 32 is then receptive of an upper cap bushing 58 which is seated in position against an upper portion 59 of the spring biasing means 56. The upper cap bushing 58 is provided with an axial hole 58' which is slidably or threadably receptive of an upper cap bolt 60. The upper portion 57 of the lever arm 32 is provided with a medianly axially placed upper lever arm hole 61. The upper lever arm hole is threadably receptive of the upper cap bolt 60 which passes through and secures the upper cap bushing 58 to the upper portion 57 of the lever arm 32. In so doing, the upper cap bushing 58 is secured into position seated against the upper portion 59 of the spring biasing means 56 holding the spring 56 in position for appropriate use. The lever arm 32 is then slidably receptive of a cylindrical housing member 62 which passes over the upper cap bushing 58, the biasing means 56 and the slidable bushing 54, to be threadably received by the lower cap nut 52. It will be recognized that the cylindrical housing member 62 slides with the lower cap nut 52 when the apparatus 10 is in operational use. It will also be recognized that the lower slidable bushing 54 helps reduce friction between the cylindrical housing 62 and the lever arm 32. It will also be recognized that the upper cap bushing 58 can be integrally formed with the lever arm 32 in alternative embodiments.

The lever arm 32 is also provided with a grip member 64. The grip member 64 is secured to the cylindrical housing 62 by a set screw means 66. It will be recognized that a number of means can be provided for securing the handle member 64. It will also be recognized that the handle member 64 will move with the cylindrical housing 62 which will be responding to the spring biasing means 56 when the lever arm 32 is in operational use. Through use of the set screw means 66, the grip member can be positioned at a selected position along the cylinder housing 62, which position is selected by a specific user of the apparatus.

It will also be recognized that the spring biasing means 56 will be exerting a downward pressure against the lower cap nut 52 vis-a-vis the lower slidable bushing 54 and that this pressure will facilitate the seating of the cylindrical housing member 62 against the upper cap bushing 58. The importance of this fact will be described in more detail below.

The grip member 64, shown in the figures, is provided with two fork-like support extensions 68*a* and 68*b*. The support extensions 68*a* and 68*b* embrace and support a transverse hand rod 70. The hand rod 70 is constructed of steel and/or other strong nonmalleable material. The hand rod 70 supports an annular cushion handle 72. In a preferred embodiment, the circumscribing cushion handle 72 will revolve around the hand rod 70 in accordance with the movement of the arm and hand during operational use. In an alternative embodiment, the hand rod 70 and the cushion handle 72 will revolve together according to the movements of the arm and hand during operational use; the axis of rotation in this embodiment will be the attachment means in the support extensions 68*a* and 68*b*, which rotatably secure the hand rod 70 and the cushion handle 72. It will be recognized that the cushion handle 72 can be constructed from a soft rubber or nylon compound, foam rubber, or any practical cushion material.

Figure 5:
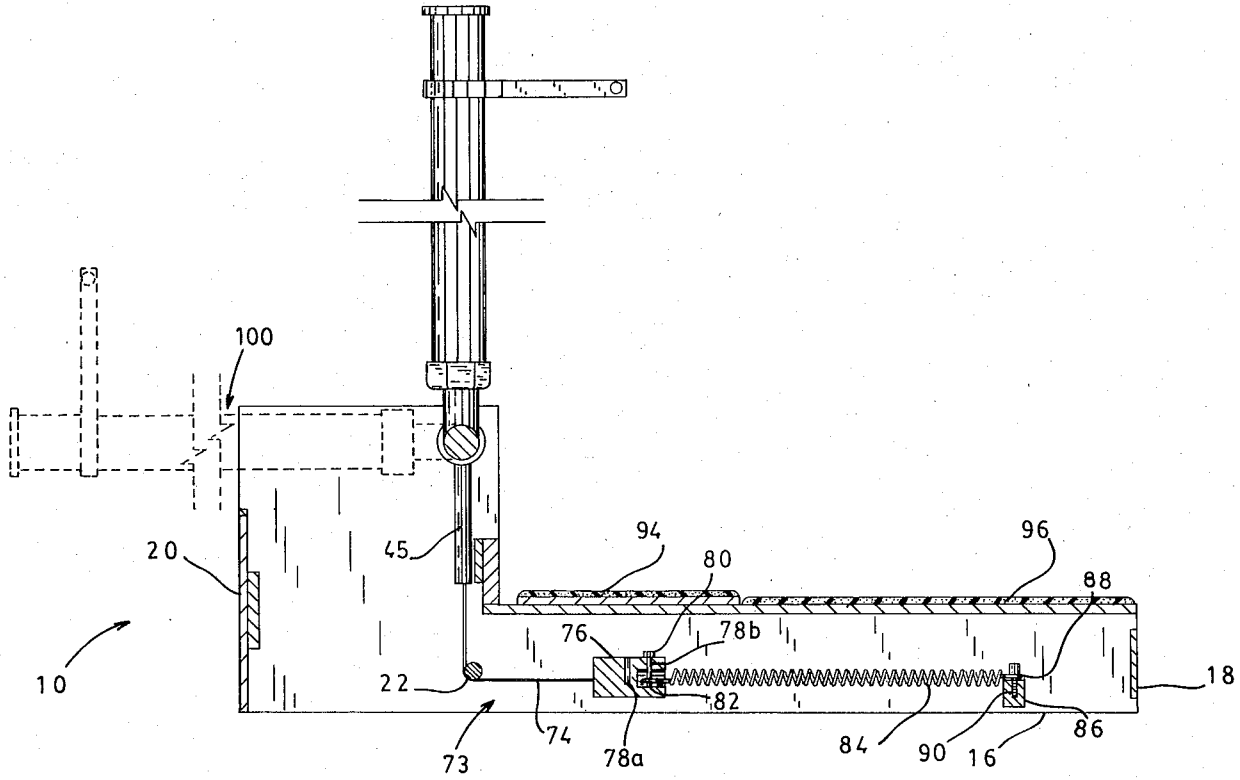
FIG. 5 is a partial cross-sectional view of the invention with emphasis on the biasing means, with phantom lines indicating the curling exercise pivotal position.

As illustrated in FIG. 3, the apparatus 10 is further provided with a biasing means 73 for selectively controlling the resistance under which the lever arm 32 rotates during operational use. A cable member 74 is pivotally attached to each of the cable posts 45 by means of a yoke member 77. It will be recognized, however, that any number of attachment means can be employed for the purpose of attaching the cable member 74 to each of the cable posts 45. Each cable 74 is then extended under the lower transverse bar 22 and through the sheave member 24. The sheave member 24 acts to position and guide the cable 74 under the lower transverse bar 22. It will be recognized that the sheave members 24 lessen friction between the cable members 74 and the lower transverse bar 22. As illustrated in FIG. 5, the cables 74 pass from the sheave members 24 on the transverse bar 22, to a rectangular biasing connection unit 76 where they are pivotally attached. It is recognized that any number of practical attachment means can be employed to attach the cable 74 to the biasing connection unit 76.

The biasing connection unit 76 is provided with a series of longitudinally paired holes, e.g., 78*a* and 78*b*. The hole closest to the incoming cable members 24 is the rest position hole 78*a*, and this hole 78*a* is receptive of a spring pin 80 not otherwise being employed for use. The further hole 78*b* is receptive of the spring pin which registers with an annular spring attachment 82 to selectively and releasably secure a biasing component 84 to the biasing connection unit 76.

It is recognized that at least one biasing component 84 will be available for use in conjunction with each of the paired holes 78*a* and 78*b*, and that with relation to each paired hole, the biasing component can either be attached at 78*b* or left free of the biasing connection unit 76. In the free position, the spring pin 80 will sit in the rest position hole 78*a*. It will be recognized that in alternative embodiments of the invention 10, the biasing components 84 can be attached to the biasing connection unit 76 in a number of suitable ways, and can also be fixedly attached in certain embodiments.

As illustrated in FIG. 5, the biasing components 84 are releasably attached to a rectangular biasing retainer member 86. The biasing retainer member is fixedly attached to the side walls 14 and 16 of the frame 12. In a preferred embodiment, the biasing components 84 are attached by means of threaded screws 88 received by threaded retainer holes 90 located on the spring retainer member 86, but a number of attachment means can be used including fixed attachment of the biasing components.

It will be recognized that a number of biasing components 84 can be provided and selectively attached between the biasing connection unit 76 and the biasing retainer member 86. It will also be recognized that the biasing components can take the form of various types of springs or may be employed in the form of hydraulic cylinders or equivalent biasing means. Further, it will be recognized that the number of biasing components 84 hooked up at any one time will accordingly influence the tension or resistance supplied to the cables 74 which will in turn influence the pressure required to move the lever arm 32 during operational use.

In an alternative embodiment of the apparatus 10, illustrated in FIG. 1B, the side walls 14 and 16 can be provided with a series of slots 92 receptive of the biasing retainer member 86. In this way, the pressure of the biasing components 84 can be selectively changed by altering the position of the biasing retainer member 86 in the side wall slots 92.

Figure 6:
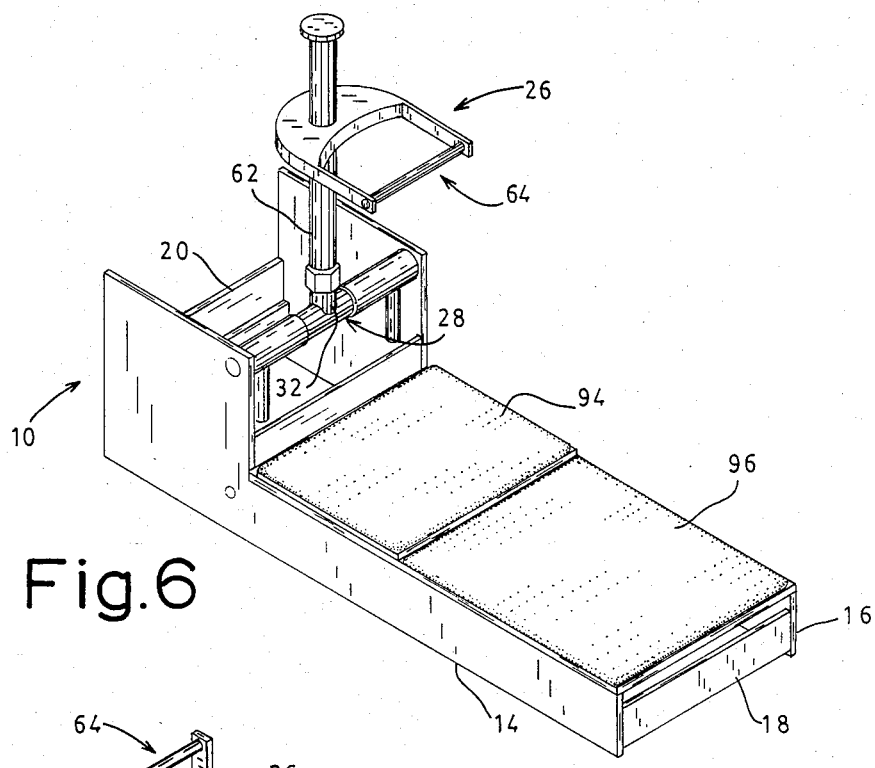
FIG. 6 is a perspective view of the invention in the arm wrestling embodiment.

The invention 10 can be provided in two basic operational embodiments. In the arm wrestling embodiment illustrated in FIG. 6, the apparatus 10 is provided with a small padded board 94 attached to a frame cover board 96. Both padded boards 94 and 96 are releasably attached to the top of the side walls 14 and 16 and act to provide a cushioning surface for elbows during immediately simulation of arm wrestling activity. It will be recognized that the board can be padded with any practical cushion-type material so as to provide a comfortable surface for placement of the arm and elbow. It is understood that either the left hand or the right hand can be used to grip the handle member 64 for the purpose of utilizing the arm wrestling embodiment.

Figure 7:
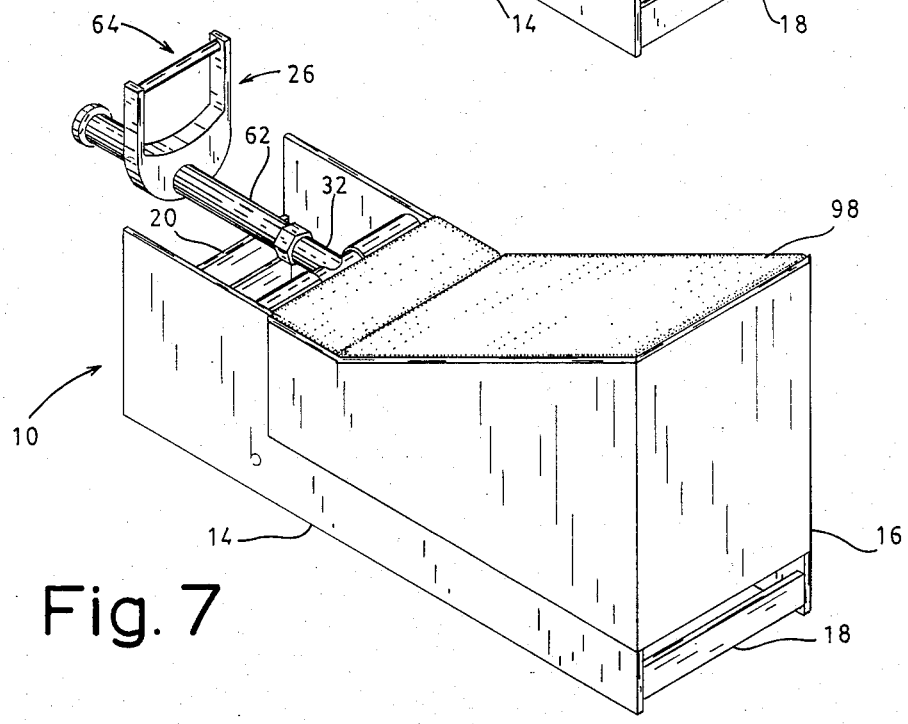
FIG. 7 is a perspective view of the invention in the arm curling embodiment.

In the arm curling embodiment illustrated in FIG. 7, the apparatus 10 is provided with a curling arm rest 98 which is releasably attached to the top of the frame cover board 96, and acts to provide an inclined plane for the upper arm to rest upon when the arm and hand are in the process of accomplishing a curling exercise. It will be recognized in this embodiment that the handle assembly 26 has been pivoted downward for appropriate access by the hand and arm as earlier described with reference to FIG. 3. It will be also recognized by those versed in the art that either the left arm or the right arm can be used in the arm curling position. It is understood that the curling arm rest 98 can be provided in a number of different styles to achieve the purpose of supporting the arm during the arm curling exercise. The curling exercise pivotal position 100 is further illustrated at FIG. 5.

It will be understood by those versed in the art that movement of the grip member 64 will entail a corresponding movement of the cylindrical housing member 62, mounted on the lever arm 32, as the arm is brought through the exercise movement. In the arm wrestling embodiment, the cylindrical housing 62 will move up the lever arm 32 as the hand is brought from the up position to the down position (see FIGS. 4 and 6). It will also be recognized that as the lever arm is brought back to the up position, the spring biasing means 56 will bias the cylindrical housing 62 back to its regular starting position. This same sequence of positions will also be facilitated in the use of the arm curling embodiment (see FIGS. 4 and 7). As the grip member 64 is curled upward to meet the upper arm, the cylindrical housing 62 will move up the lever arm 32, and as the lever arm is returned to its starting position, the cylindrical housing 62 will be biased to its starting position. In so doing, the relative lengths of the arm during exercise movement are compensated for.

From the foregoing detailed description, it will be recognized by those skilled in the art that several advantageous features exist with relation to the arm wrestling and curling exercise apparatus 10. The dual embodiments of the invention will provide to the exercise participant both an arm wrestling apparatus and a curl exercise apparatus, thus presenting a wider range of available exercise activity from the same unit, and facilitating the selective use of both types of exercise. In the arm wrestling mode, the apparatus will present itself as a prospective opponent with selective strength levels by virtue of the chosen number of biasing components 84 utilized in connection with the biasing means 73. When operating in the arm curl exercise mode, the participant will be presented with selectively different pressures to lift against. Therefore, variable weight resistances will be available to operate against in both the arm wrestling and arm curling modes.

It will also be recognized that the biasing means 73 will facilitate a more sensitive resistance control means during the course of operational use. This will provide a wider choice of resistance levels against which to perform the arm wrestling and arm curling movements. The apparatus 10 will provide an easy means for changing resistance levels. The apparatus will also be less likely to need bothersome repairs during operational use. It will also be recognized that the apparatus 10 provides a significantly improved handle assembly 26 whereby the grip member 64 will extend itself outwardly to compensate with the movement of the arm during operational use in the arm wrestling mode or the arm curling mode. In the course of this movement, it will also be recognized that the grip member 64 will automatically return to its proper position as the hand or arm is returned to its starting position by virtue of a spring biasing means 56.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An apparatus useful for selectable arm wrestling and arm curling exercise by a user, which comprises:

a frame membbr a lever arm having a first end pivotally mounted on said frame member, and a second end;

a grip means, slidably reciprocatable along said lever arm proximate said second end during said exercise whereby an effective length of said lever arm and said grip means varies during said exercise to compensate for a change in an effective length of an arm of said user;

a first biasing means connected between said grip means and said lever arm for biasing said grip means toward said first end of said lever arm; and a second biasing means connected between said lever arm,. proximate said pivotal mounting, and said frame for biasing said lever arm to preselected pivotal positions whereby said second biasing means provides selective resistance against which said selectable arm wrestling and arm curling exercise is performed.

2. An apparatus useful for arm wrestling and arm curling exercise, which comprises:

a frame member;

a pivot shaft pivotally mounted on said frame member;

a lever arm having a first end joined to and extending substantially perpendicular from said pivot shaft, and a further end;

a cylindrical housing receptive of said further end of said lever arm and having a first end toward said pivot shaft and a further end;

a spiral spring means mounted within said housing and surrounding said further end of said lever arm, said spring means biasing said housing toward said pivot shaft but permitting forceful movement of said housing away from said pivot shaft and wherein said grip means is releasably mounted on said cylindrical housing such that said cylindrical housing slidably reciprocates on said lever arm when said grip means is moved when exercise is performed; and a biasing means connected between said pivot shaft and said frame for biasing said lever arm to preselected pivotal positions whereby said biasing means provides selective resistance against which said exercise is performed.

3. The apparatus of claim 2 further comprising:

a first bushing member encircling said lever arm and disposed within said first end of said cylindrical housing for engaging a first end of said spring means;

an internally threaded cap threadably engaged with said first end of said housing for retaining said first bushing within said housing, said cap being provided with an aperture to accept said lever arm; and a further bushing member within said further end of said housing and fastened to said further end of said lever arm for engaging a further end of said spring means, said further bushing member serving to slidably engage said cylinder housing and providing a biasing surface for engaging said spring means.

4. The apparatus of claim 3 further comprising a yoke projecting perpendicularly from said cylindrical housing, said yoke having a first end encircling said cylindrical housing, and a further end provided with an opening to receive to receive an hand of a user;

an adjustment means attached to said first end of said yoke for releasable attachment of said yole to said cylindrical housing at selected positions along said cylindrical housing;

a rotatable rod extending across said opening for grasp by said hand of said user during exercise using said apparatus; and an annular cushion grip rotatably attached to said rod which revolves around said rod in accordance with the movement of said hand during operational use of said apparatus.

5. The apparatus of claim 2 wherein said pivot shaft is provided with at least two sleeve members each of which is releasably mounted on either side of said lever arm, said sleeve member carrying a cable post directed substantially opposite to said lever arm, and further comprises a cable member connected at a first end to said biasing means and pivotally connected at further end to said cable post.

6. The apparatus of claim 5 wherein said biasing means comprises:

a biasing connection unit movable within said frame having first and second end portions, said first end portion of said biasing connection unit being releasably attached to said first end of said cable member.

at least one biasing component having first and second end portions, said first end portion of said biasing component being releasably attached to said second end portion of said biasing connection unit; and a biasing retainer unit, said retainer unit being releasably attached to said second end portion of said biasing component and fixably secured to said frame.

7. The apparatus of claim 6 wherein said frame member comprises:

a pair of parallel side walls, oppositely disposed to each other;

a pair of end walls joined to ends of said side walls; and a lower transverse bar disposed parallel with said piviot shaft, secured at its opposite end portions to said side walls, said bar being provided with at least two sheave members, selectively spaced and rotatably mounted for carrying said cable member between said cable posts and said biasing connection unit.

8. The apparatus of claim 6 wherein said biasing component is at least one spring member having first and further end portions.

9. The apparatus of claim 8 wherein said biasing connection unit further comprises:

a medianly displaced portion provided with a plurality of paired holes, said pair defining an inwardly disposed hole and an outwardly disposed hole;

a spring pin for selectively being received in one of said paired holes;

wherein said outwardly disposed hole is receptive of said spring pin for selectively and releasably attaching said first end portion of said biasing component to said biasing connection unit; and wherein said inwardly disposed hole is receptive of said spring pin for storage of said spring pin when said first end portion of said biasing component is not attached to said biasing connection unit.

10. The apparatus of claim 7 wherein said biasing retainer unit is fixedly secured at its opposite portions to said side walls of said frame member.

11. The apparatus of claim 8 wherein said biasing retainer unit is provided with a plurality of threaded holes and further comprises a threaded screw received in said holes which register with said further end portion of said biasing component to releasably secure said biasing component to said biasing retainer unit.

12. The apparatus of claim 6 wherein said biasing component is a hydraulic cylinder unit.

13. The apparatus of claim 7 wherein said side walls of said frame member are provided with a plurality of paired slots which are selectively receptive of said biasing retainer unit at its opposite end portions whereby said biasing means provides said resistance against which said exercise is performed.

14. The exercise apparatus of claim 7 wherein said frame member further comprises a flat padded board, said board being selectively received by, and conforming to the perimeters of, said parallel side walls, and protectively covering said biasing means.

15. The exercise apparatus of claim 7 wherein said frame member further comprises a box-like structure provided at its top outboard portion with an inclined plane surface which extends substantially downwardly to a flat outboard surface corresponding in level to said pivot shaft, said box-like structure being selectively received by, and conforming to the perimeters of, said parallel side walls, and protectively covering said biasing means.

16. The apparatus of claim 5 wherein said pivot shaft is provided with a first pair of holes disposed proximate a midpoint of a first of said sleeve members and a further pair of holes disposed proximate a midpoint of said further of said sleeve members, each of said pair of holes disposed at selected locations along a common periphery about said pivot shaft; wherein each of said first and further sleeve members is provided with a hole to register with one of said holes in said shaft; and further comprises a pair of fastening pins to pass through each of said holes in said sleeve members and releasably engage one of said holes of each of said pairs in said pivot shaft whereby said sleeve members are nonrotatably attached to said pivot shaft at one of said selected locations.

17. An exercise apparatus useful for arm wrestling and arm curling, which comprises:

a frame member;

a handle assembly pivotally mounted on said frame member, said handle assembly including a pivot shaft pivotally mounted on said frame member, a lever arm having a first end joined to, and extending perpendicularly from, said pivot shaft, and having a second end, and a grip means, said grip means axially reciprocatable along said lever arm during said exercise whereby an effective length of said lever arm and said grip means varies during said exercise to compensate for a change in an effective length of an arm of said user;

a biasing means connected between said handle assembly and said frame member for biasing said handle assembly to preselected pivotal positions whereby said biasing means provides resistance against which exercise is performed;

a cylindrical housing receptive of said further end of said lever arm and having a first end toward said pivot shaft and a further end;

a spiral spring means mounted within said housing and surrounding said further end of said lever arm, said spring means biasing said housing toward said pivot shaft but permitting forceful movement of said housing away from said pivot shaft; and wherein said grip means is releasably mounted on said cylindrical housing such that said cylindrical housing slidably reciprocates on said lever arm when said grip means is moved when exercise is performed.

18. The apparatus of claim 7 wherein said side walls are further provided with journaling holes carrying annular bushing members, wherein said bushing members are rotatably receptive of said pivot shaft.

* * * * *